US005119129A

United States Patent [19]

Setani

[11] Patent Number: 5,119,129

[45] Date of Patent: Jun. 2, 1992

[54] IMAGE FORMING APPARATUS WITH SELECTABLE FIRST AND SECOND OPTICAL FORMING MEANS

[75] Inventor: Michitaka Setani, Kawasaki, Japan

[73] Assignee: Canon Kabushiki Kaisha, Tokyo, Japan

[21] Appl. No.: 607,758

[22] Filed: Oct. 30, 1990

Related U.S. Application Data

[63] Continuation of Ser. No. 283,905, Dec. 13, 1988, abandoned.

[30] Foreign Application Priority Data

Dec. 15, 1987 [JP] Japan ..... 62-317238

[51] Int. Cl.[5] ..... G03G 15/00

[52] U.S. Cl. ..... 355/202; 355/239; 355/246; 346/160

[58] Field of Search ..... 355/239, 202, 210, 218, 355/220, 234, 235, 244, 214, 265, 246; 346/153.1, 160

[56] References Cited

U.S. PATENT DOCUMENTS

| | | | |
|---|---|---|---|
| 4,330,195 | 5/1982 | Lavallee | 346/160 X |
| 4,472,047 | 9/1984 | Stoudt . | |
| 4,493,549 | 1/1985 | Thomas et al. | 355/3 R |
| 4,517,579 | 5/1985 | Kitamura | 346/160 |
| 4,578,689 | 3/1986 | Spencer et al. | 346/160 |
| 4,619,522 | 10/1986 | Imai | 355/208 |
| 4,701,042 | 10/1987 | Mimura et al. | 355/265 |
| 4,728,991 | 3/1988 | Takayama et al. | 355/14 TR |
| 4,740,818 | 4/1988 | Tsilibes et al. . | |
| 4,768,046 | 8/1988 | Minor et al. | 346/157 X |
| 4,783,680 | 11/1988 | Maloney | 355/239 X |
| 4,855,767 | 8/1989 | Sato et al. | 346/160 |

FOREIGN PATENT DOCUMENTS

| | | |
|---|---|---|
| 0047180 | 3/1982 | European Pat. Off. . |
| 0123437 | 10/1984 | European Pat. Off. . |

*Primary Examiner*—R. L. Moses

*Attorney, Agent, or Firm*—Fitzpatrick, Cella, Harper & Scinto

[57] ABSTRACT

An image forming apparatus including a movable photosensitive member, a first optical device for projecting light from an original onto the photosensitive member, second optical device for projecting a dot pattern to the photosensitive member before, upon or after formation of the image projected onto the photosensitive member by the first optical device, the second exposure device projecting onto the photosensitive member a beam modulated in accordance with a signal modulated to provide the dot pattern, and a selector device for selection between a first mode wherein an image is formed by the first optical device and a second mode wherein an image is formed by the first and second optical device.

16 Claims, 3 Drawing Sheets

IMAGE FORMING APPARATUS WITH SELECTABLE FIRST AND SECOND OPTICAL FORMING MEANS

This application is a continuation of application Ser. No. 283,905 filed Dec. 13, 1988, now abandoned.

FIELD OF THE INVENTION AND RELATED ART

The present invention relates to a image forming apparatus usable with an electrophotographic copying apparatus or the like, and more particularly to such an apparatus wherein an original having a continuous tone, such as a photograph, is reproduced.

In an electrophotographic copying apparatus of this type, an image bearing member is uniformly charged electrically and exposed to light of an image on an original by an exposure optical system so that an electrostatic latent image is formed, which in turn is visualized by developing means, thus reproducing an original. Generally, a tone reproducing property in an electrophotographic method is such that the contrast of the reproduced image is higher than that of an original image, since a so-called gamma property which is the slope of a line on an original density vs. reproduced density curve, is large. This property is advantageous in the case of a document containing characters, wherein the original contains only black and background white portions without half-tone areas. In such circumstances this property leads to good quality copy. However, for a continuous tone original such as a photograph having many half-tone areas, the large gamma property leads to unfaithful reproduction of the half-tone area, which is disadvantageous.

In consideration of this, a generally used method is that a surface of an original is covered with a white dot screen when the half-tone area is to be reproduced more faithfully. The white dot screen provides a half-tone dot effect to reduce the contrast, thus increasing the tone reproducibility.

However, such a method requires additional work for covering the original with the screen whenever the half-tone reproduction is desired, and therefore, additional cumbersome work is imposed on the operator. In addition, by simply covering the original with the white dot screen, the half-tone reproducibility is improved due to the reduction of the gamma property, but the copy density of a low density portion of the original decreases, with the result that a so-called high-light portion is washed-out, and therefore, is not sufficiently reproduced.

SUMMARY OF THE INVENTION

Accordingly, it is a principal object of the present invention to provide an image forming apparatus wherein the half-tone reproducibility is improved without imposing special work such as covering the original with a screen or the like.

It is another object of the present invention to provide an image forming apparatus wherein the half-tone reproducibility is improved, and simultaneously, the low density reproducibility is also improved.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
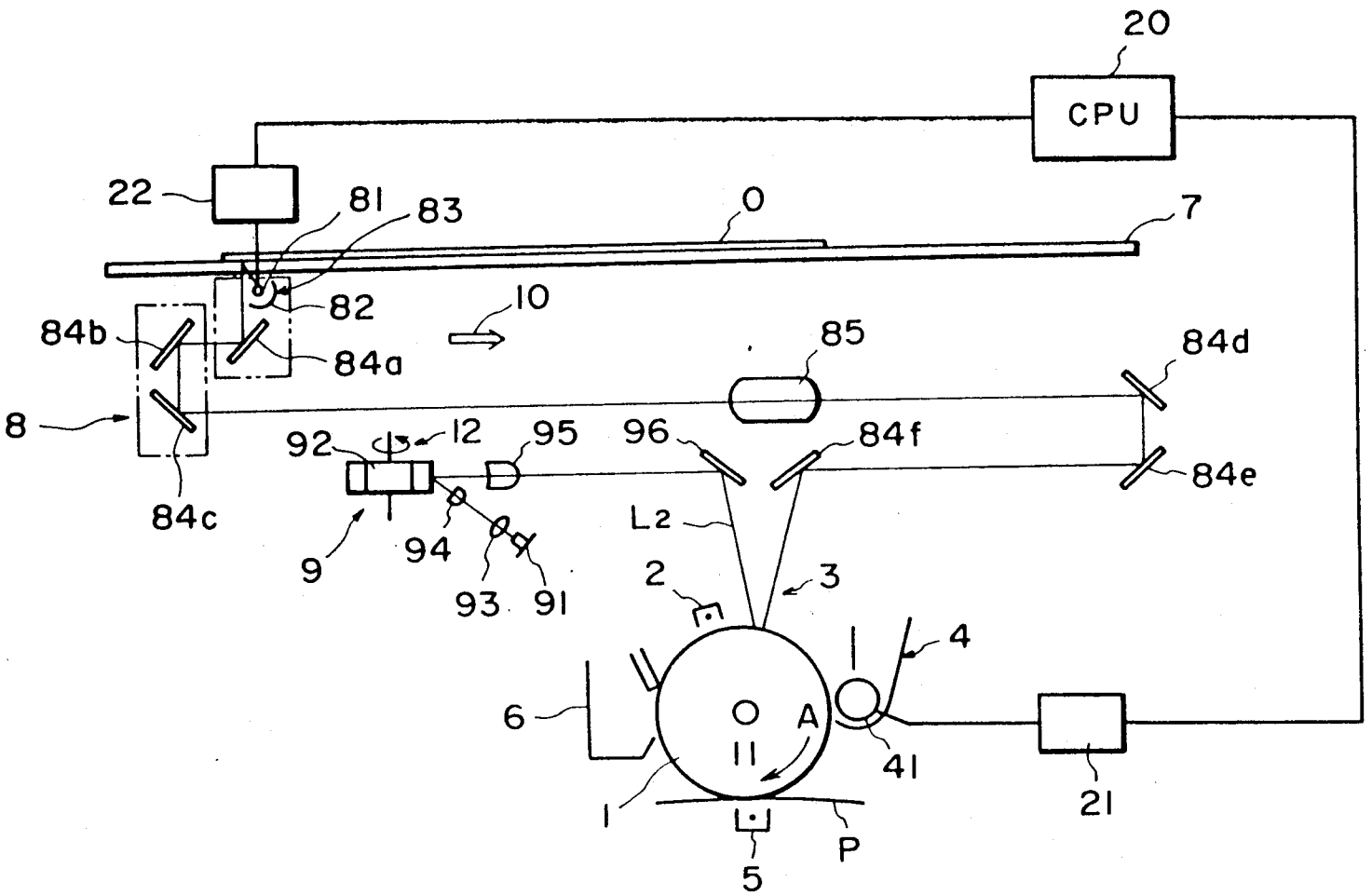
FIG. 1 is a sectional view of an electrophotographic apparatus of an image forming apparatus according to an embodiment of the present invention.

Referring to FIG. 1, there is shown an electrophotographic copying machine which is an exemplary image forming apparatus according to an embodiment of the present invention, which comprises a photosensitive drum 1 functioning as an image bearing member. In this embodiment, the photosensitive drum includes an OPC (organic photoconductor) photosensitive layer. It may be made of another material such as Se, amorphous Si and ZnO.

Around the photosensitive drum 1, there are disposed a primary charger 2, an exposure station 3, a developing device 4, an image transfer charger 5 and cleaner 6 which constitute an electrophotographic process means. Those elements and station are disposed in the order named in a rotational direction A of the photosensitive drum 1. The exposure station 3 includes a first exposure optical system 8 for forming an image of an original O placed on an original supporting platen glass 7 on the photosensitive drum 1, and a second exposure optical system 9 which is disposed separately from the first exposure optical system 8 and which projects a light beam modulated in accordance with an image signal in the form of a dot pattern. The surface of the photosensitive drum 1 is uniformly charged by a primary charger 2 and then is exposed to the light of the original image through the first exposure optical system 8, so that an electrostatic latent image is formed, which is in turn developed with a developer by the developing device 4. The developed or visualized image is transferred onto a transfer sheet P by a transfer charger 5, and is fixed by an unshown image fixing device.

The first exposure optical system comprises illumination means 83 having an illumination source 81 for illuminating an image surface of the original 0 and a shade, first - sixth mirrors 84*a*, 84*b*, 84*c*, 84*d*, 84*e* and 84*f* for sequentially reflecting the light emitted from the illumination means 83 and reflected by the original O, and an imaging lens 85. The first mirror 84*a* moves with the illumination means 83, and the second and third mirrors 84*b* and 84*c* are moved together, in the direction 10 in synchronism with the rotational speed of the photosensitive drum 1 to scan the image surface of the original to expose the photosensitive drum 1 with an image of the original.

On the other hand, the second exposure optical system 9 comprises a semiconductor laser 91 for emitting a light beam and a rotational mirror 92 (polygonal mirror in this embodiment) for scanning the pulse beam emitted by the semiconductor laser 91 in a main scanning direction, which is a direction perpendicular to the rotational direction of the photosensitive drum 1. Between the semiconductor laser 91 and the rotational polygonal mirror 92, there are disposed a collimator lens 93 and a cylindrical lens 94, and between the rotational mirror 92 and the photosensitive drum 1, there are disposed a toric lens 95 and a reflecting mirror 96 for folding the optical path.

A pulse beam modulated directly by the semiconductor laser 91 in accordance with a signal to constitute a desired dot pattern is collimated by the collimator lens 93, and thereafter, is focused on a reflecting surface of the rotational mirror 92 by the cylindrical lens 94 only in the circumferential direction of the photosensitive drum, so that a focused line is formed along the axis of the photosensitive drum 1. The rotational mirror 92 is rotated in a direction indicated by an arrow 12 in synchronism with the rotational speed of the photosensitive drum, and reflects the focused line laser beam to scan the photosensitive drum 1 in a direction of a generating line of the photosensitive drum 1 (main scan). The toric lens 95 focuses the reflected beam L2 on the photosensitive drum 1 and has a function of deviating a scanning line in the subordinate scanning direction attributable to the tilt of each reflecting surface of the rotational mirror 92 by cooperation with the cylindrical lens 94. The reflecting mirror 96 disposed adjacent to the photosensitive drum 1 directs the scanning line to a desired position on the photosensitive drum 1.

On the other hand, the density of the image reproduced by the electrostatic deposition of the developer on the photosensitive drum 1 is determined by, for example, the relation between the surface potential of the electrostatic latent image formed by the exposure and a bias voltage applied to the developing device 4, and the relation is controlled by a CPU (central processing unit) functioning as a density control means. More particularly, the CPU 20 is effective to change the setting of the reproduced image density between for a usual original (a document without tone) and for a continuous tone original (a photograph having tone). When the setting for the continuous tone original is selected, the second exposure optical system 9 projects a regular dot pattern, and therefore, the reproduced image densities of the continuous tone original and the usual original are different. The setting of the reproduced image density here means the reproduced image density without the dot pattern exposure.

Figure 2:
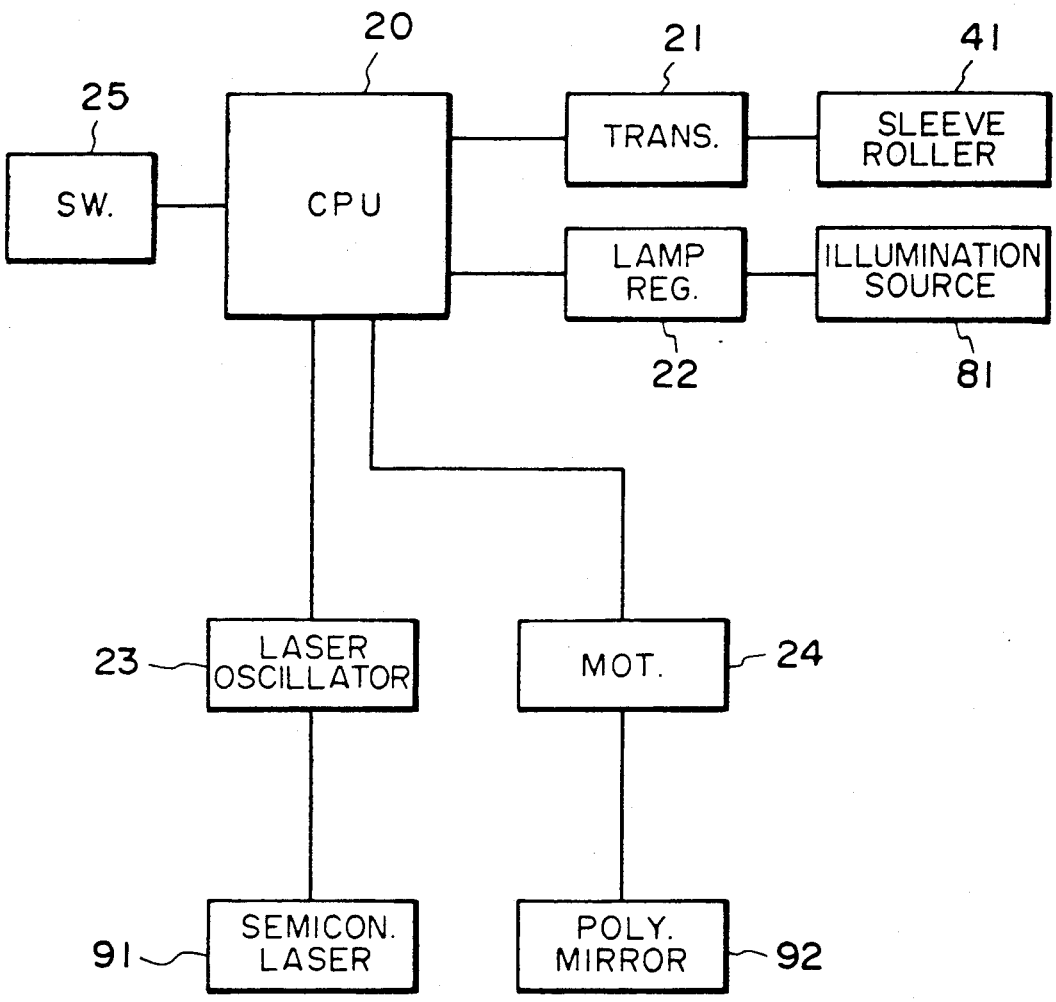
FIG. 2 is a control block diagram for the apparatus of FIG. 1.
Figure 3A:
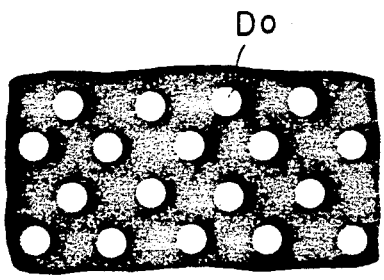
FIG. 3A and 3B are schematic enlarged view of examples of images produced by the apparatus of FIG. 1.
Figure 3B:
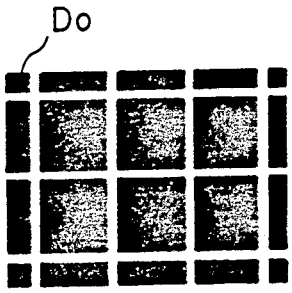
Figure 4:
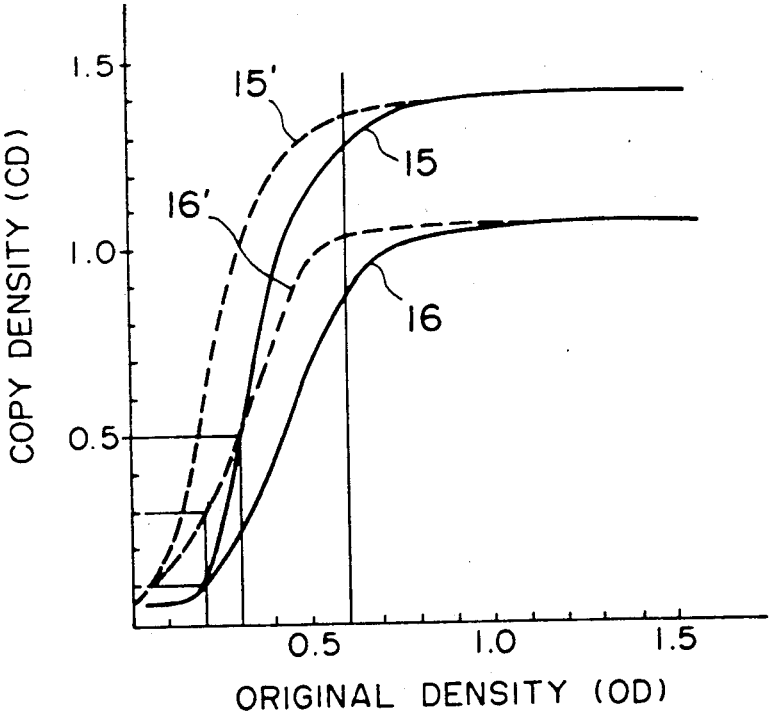
FIG. 4 is a graph of original density vs. copy density reproducibility.

Referring to FIG. 2, there is shown an example of a block diagram of the control system. The CPU 20 is connected with a sleeve roller 41 of the developing device 4 through a developing high voltage transformer 21 and also with an illumination source 81 of the first exposure optical system 8 through a lamp regulator 22. Also, the CPU 20 is connected with a semiconductor laser 91 through a laser oscillation circuit 23 and with a polygonal mirror 92 through a polygonal mirror driving motor 24. The CPU 20 is provided with a switch 25 for selection between a usual original mode and a continuous tone original mode. In an image forming apparatus with the above structure, when a continuous tone original such as a photograph is to be copied, the photograph (continuous tone original) mode is selected by the selector switch 25. The selector switch 25 may be manually operated on the basis of discrimination by the operator, or may be automatically operated in response to a comparator, or the like, receiving an image signal which is produced by reading the image density of the original by CCD or the like. During the image forming operation, a pattern D0 produced by a laser beam emitted from the semiconductor laser 91 of the second exposure optical system 9 as shown in FIGS. 3A and 3B is overlaid on the exposure image formed and imaged on the photosensitive drum 1 by the first exposure optical system 8. Accordingly, an exposure pattern, as if modified by white dots, is provided. The latent image formed as a potential contrast pattern in this manner is developed by a developing device 4, and the developed image is transferred and fixed on transfer material, so that a reproduction can be provided. In this example, the image resolution of the laser beam is 4 pel/mm, but it may be 2–12 pel/mm to improve the half-tone reproduction. Referring to FIG. 4, there is shown a relationship between a copy image density CD of the reproduced image and an original density OD. In this FIG., a curve 15 shows the relation when the dot pattern by the second exposure optical system 9 is not overlaid, which is desirable for copying the usual document having characters or the like. A curve 16 indicates the relation when the dot pattern by the second exposure optical system 9 is overlaid. As will be understood, the gamma property (CD/OD) is reduced, so that the reproducibility of the half-tone (continuous tone) reproducibility is improved.

However, when the original density 0D is 0.3, the copy density is reduced to the neighborhood of 0.2 which was originally 0.5, with the result that the highlight portion of the original is washed out. To solve this problem, the present invention changes, when the photograph original mode is selected, the developing bias applied on the sleeve of the developing device and/or the quantity of light (voltage) of the lamp of the first exposure optical system by the CPU 20 functioning as the density control means, by which the density curve 15 by the first exposure optical system 8 is shifted upwardly as shown by the curve indicated by 15'. When this is done, the density curve 16 with the dot pattern by the second exposure optical system 9 is also upwardly shifted as indicated by a reference 16'. The upward shift of the density curve upon the photographic original mode can be accomplished, for example, by decreasing a DC voltage of the developing bias as compared with a usual original mode, by decreasing the light quantity (voltage) of the lamp of the first exposure optical system, or by a peak-to-peak voltage of an alternating voltage when an alternating voltage which is a voltage periodically changing with time is applied as the developing bias. As another example, the process speed of the photosensitive member can be made higher in the photographic original mode than in the usual original mode, by which the amount of light by the first, exposure optical system 8 is in effect reduced, and by which the density curve can be shifted upwardly. The apparatus according to this embodiment is advantageous for an original having mixed characters, letters and photograph regions. For such an original, a photograph region of the original can be designated by the operator, by which the dot pattern by the laser beam can be projected only to the region of the photosensitive member which corresponds to the designated region of the original. In the foregoing embodiment, the description has been made with respect to the dot pattern projected to the region of the photosensitive member which is exposed to image light of the original, but LED array and a liquid crystal shutter array for applying the dot pattern by modulated signals to provide the dot pattern is usable in place of the laser.

As described in the foregoing, the apparatus according to the present invention is operable in a first mode wherein the light reflected by the original is projected onto the photosensitive member and in a second mode wherein the light reflected by the original is applied on the photosensitive member, and simultaneously, a dot pattern provided by modulating an image signal is also applied to the applied image. The modes are selectable in accordance with the nature of the original, and therefore, image reproducibility and operativeness are improved.

Also, since the setting of the reproduced image density ca be changed for the continuous tone original by the density control means, the reproducibility of the low density portion of the original is improved, so that the quality of the reproduced image is improved.

As shown in FIG. 1, the dot pattern image is projected onto the photosensitive member, immediately before the image formed by the analog optical system for projecting the image of the original placed on the original supporting table. But, the dot pattern may be projected simultaneously or after projection of the analog image.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable photosensitive member;

first optical means for projecting an image from an original onto said photosensitive member;

second optical means for projecting a dot pattern onto the photosensitive member before, upon, or after formation of the original image projected onto the photosensitive member by said first optical means, said second optical means projecting onto said photosensitive member a beam modulated in accordance with a signal modulated to provide the dot pattern;

selector means for selection between a first mode wherein an image is formed by said first optical means and a second mode wherein an image is formed by said first and second optical means; and density control means for controlling a density of an image in accordance with a mode selected by said selector means.

2. An apparatus according to claim 1, wherein said density control means provides a setting of a reproduced image density in the first mode and a setting of a reproduced image density in the second mode which is higher than in the first mode.

3. An apparatus according to claim 1, further comprising a developing means for developing a latent image formed on said photosensitive member by said first optical means or by said first and second optical means.

4. An apparatus according to claim 1, wherein said density control means controls a quantity of light projected onto said photosensitive member by said first optical means.

5. An apparatus according to claim 2, wherein said density control means provides a quantity of light projected onto the photosensitive member by said first optical means which is smaller in the second mode than in the first mode.

6. An apparatus according to claim 1, further comprising developing means for developing a latent image formed on said photosensitive member by said first optical means or by said first and second optical means.

7. An apparatus according to claim 6, wherein a bias voltage is applied to said developing means, and wherein said density control means controls a bias voltage applied to said developing means.

8. An apparatus according to claim 7, wherein said bias voltage contains a DC voltage component, and wherein said density control means controls the DC voltage component applied to the developing means.

9. An apparatus according to claim 7, wherein said bias voltage contains an alternating voltage component, and wherein said density control means controls an alternative voltage applied to said developing means.

10. An apparatus according to claim 2, further comprising developing means for developing a latent image formed on said photosensitive member by said first optical means or by said first and second optical means.

11. An apparatus according to claim 10, further comprising means for applying a DC voltage to said developing means, and wherein said density control means lowers the DC voltage in the second mode as compared with the first mode.

12. An apparatus according to claim 10, wherein an alternating voltage is applied to said developing means, and wherein said density control means increases a peak-to-peak voltage of the AC voltage in the second mode as compared with the first mode.

13. An apparatus according to claim 1, wherein said second optical means projects a laser beam onto said photosensitive member.

14. An apparatus according to claim 1, wherein the first mode and the second mode are selected in accordance with an image density of the original.

15. An apparatus according to claim 14, wherein the first mode and the second mode are selected in accordance with a tone of the original.

16. An apparatus according to claim 15, wherein when the original is a document containing characters, the first mode is selected by said selector means, and when the original is a photographic original, the second mode is selected by said selector means.

* * * * *

UNITED STATES PATENT AND TRADEMARK OFFICE

CERTIFICATE OF CORRECTION

PATENT NO. : 5,119,129 Page 1 of 2

DATED : June 2, 1992

INVENTOR(S) : Setani

It is certified that error appears in the above-identified patent and that said Letters Patent is hereby corrected as shown below:

On the Title page, item,

[57] ABSTRACT:

Line 14, "vice." should read --vices.--

COLUMN 1:

Line 11, "a" should read --an--;

Line 13, "particularly" should read --particularly,--; and

Line 25, "property" should read --property,--.

COLUMN 2:

Line 8, "view" should read --views--;

Line 46, "first exposure optical system" should read --first exposure optical system 8--; and Line 48, "original 0" should read --original O--.

COLUMN 4:

Line 6, "transfer" should read --a transfer--;

Line 7, "a" should be deleted;

UNITED STATES PATENT AND TRADEMARK OFFICE

CERTIFICATE OF CORRECTION

PATENT NO. : 5,119,129 Page 2 of 2

DATED : June 2, 1992

INVENTOR(S) : Setani

It is certified that error appears in the above-identified patent and that said Letters Patent is hereby corrected as shown below:

COLUMN 4:

Line 22, "density OD" should read --density OD--; and

Line 48, "first," should read --first--.

COLUMN 5:

Line 9, "ca" should read --can--.

Signed and Sealed this

Seventeenth Day of August, 1993

Bruce Lehman

*Attest:*

BRUCE LEHMAN

*Attesting Officer*

*Commissioner of Patents and Trademarks*